United States Patent [19]

Duda

[11] 4,163,299

[45] Aug. 7, 1979

[54] PORTABLE GOLF BALL WASHER

[76] Inventor: Alex J. Duda, 1704 S. Pennsylvania, Lansing, Mich. 48910

[21] Appl. No.: 881,558

[22] Filed: Feb. 27, 1978

[51] Int. Cl.[2] ..... A63B 47/04

[52] U.S. Cl. ..... 15/21 A

[58] Field of Search ..... 15/21 A, 97 R, 104.92

[56] References Cited

U.S. PATENT DOCUMENTS

| | | | |
|---|---|---|---|
| 1,871,139 | 8/1932 | Wilcox, Jr. et al. | 15/21 A |
| 2,814,813 | 12/1957 | Young | 15/21 A X |
| 3,041,645 | 7/1962 | Smith | 15/21 A X |
| 3,077,626 | 2/1963 | Thomson | 15/21 A X |
| 3,981,039 | 9/1976 | Rumph | 15/21 A |
| 4,069,536 | 1/1978 | Hartz et al. | 15/104.92 |

FOREIGN PATENT DOCUMENTS

| | | | |
|---|---|---|---|
| 203108 | 9/1923 | United Kingdom | 15/21 A |

*Primary Examiner*—Edward L. Roberts
*Attorney, Agent, or Firm*—Malcolm R. McKinnon

[57] ABSTRACT

A portable golf ball washer including a cylindrical housing defining a washing chamber, the housing having an opening in a peripheral wall thereof permitting a conventional golf ball to be inserted into the washing chamber, ball scrubbing means disposed in the washing chamber, manually actuatable means rotatable in one direction about the longitudinal axis of said cylindrical housing for impelling a golf ball in a substantially circular path over the scrubbing means and simultaneously rotating the ball about various axes, the manually actuatable means being rotatable in the opposite direction about said axis for ejecting the ball through said opening, and means for releasably securing the housing to a support such as a golf cart or a golf bag.

2 Claims, 5 Drawing Figures

PORTABLE GOLF BALL WASHER

BRIEF SUMMARY OF THE INVENTION

This invention relates to golf ball washers and, more particularly, to an improved portable golf ball washer incorporating improved means for washing, scrubbing and cleaning golf balls.

As is well known in the art, heretofore numerous prior devices have been devised and utilized for the purpose of washing and cleaning golf balls. The greatest majority of such prior golf ball washing devices have been devised for stationary installation and are usually permanently installed at selected tee or other appropriate areas on a golf course. However, as is also well known in the art, permanently installed golf ball washing devices are often subject to neglect, vandalism and abuse and as a result are often inoperative, broken or out of repair. In addition, the groundskeeping personnel often fail to refill the permanently installed devices at sufficiently frequent intervals with water and soap or other cleaning fluids and consequently the dry devices are often unusable for golf ball cleaning purposes for extended periods of time. Heretofore, various portable golf ball washers have also been devised which are intended to be transported by the golfer and/or by a golf cart. However, prior portable golf ball washers have tended to be relatively complicated and/or expensive and/or have been deficient in other respects such as in ball washing and cleaning capabilities and/or have required personal manual manipulation of the golf ball during the washing and cleaning process with the result that prior portable golf ball washers have failed to achieve significant acceptance in the marketplace.

An object of the present invention is to overcome disadvantages in prior golf ball washing and cleaning devices of the indicated character and to provide an improved golf ball washer which is portable and which may be readily transported by a golfer as he or she traverses a golf course.

Another object of the invention is to provide an improved portable golf ball washer which incorporates improved means for washing, scrubbing and cleaning golf balls.

Another object of the invention is to provide an improved portable golf ball washer incorporating improved means for impelling and simultaneously scrubbing a golf ball during the washing and cleaning process and thereafter automatically ejecting a washed and cleaned ball from the portable washer.

Another object of the invention is to provide an improved portable golf ball washer which is adapted to wash, scrub and clean a golf ball and which may be easily secured to a manually pulled and/or powered golf cart or to a golf bag whereby the golf ball washer will be readily available to a golfer as the golfer traverses the golf course.

Still another object of the present invention is to provide an improved portable golf ball washer that is relatively simple in construction, economical to manufacture and assemble, durable, efficient, and reliable in operation.

The above as well as other objects and advantages of the present invention will become apparent from the following description, the appended claims and the accompanying drawings.

DETAILED DESCRIPTION

Figure 1:
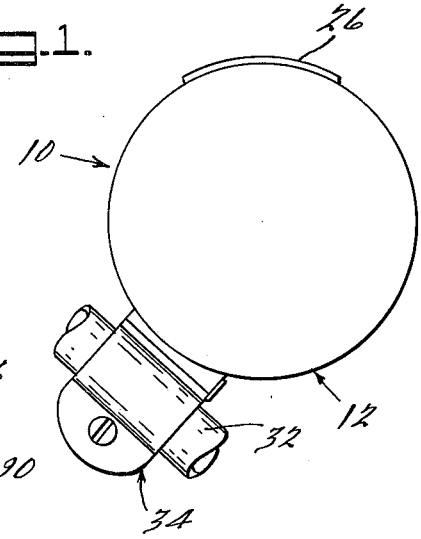
FIG. 1 is a side elevational view of a portable golf ball washer embodying the present invention, showing the same installed on a handle of a golf cart.

Referring to the drawings, a preferred embodiment of the invention is illustrated therein and is comprised of a portable golf ball washer, generally designated 10, which may be readily transported by a golfer as he or she traverses a golf course and which is thus readily available for use in washing and cleaning a golf ball not in play at any time and also readily available to wash and clean a ball in play as permitted by the rules of the game. The portable golf ball washer 10 may be constructed of any desired or conventional materials having sufficient strength to withstand the forces exerted thereon and includes a substantially cylindrical housing 12 having a cylindrical peripheral wall 14 and end walls 16 and 18 that define a washing chamber 20 adapted to contain water, soap, detergent and/or other desired cleaning liquids. An opening 22 is provided in the cylindrical peripheral wall 14, the opening 22 being of sufficient size to permit a conventional golf ball, such as 24, to be inserted into the washing chamber 20. A removable, curved, resilient cap 26 is provided for the opening 22, the cap 26 having a peripheral flange portion 28 which is greater in diameter than the opening 22, and a central portion 30 which is adapted to have a snug fit in the opening 22 whereby the central portion may be inserted into the opening 22 while the flange portion 28 extends circumferentially around the opening 22 to prevent water and/or other washing liquid from splashing out of the chamber 20 when the cap 26 is utilized to close the opening 22.

In the embodiment of the invention illustrated, means is provided for releasably securing the portable golf ball washer 10 to a tubular handle 32 of a conventional manually pulled golf cart (not shown), it being understood that the portable golf ball washer may also be secured to a golf bag or a powered golf cart in any suitable manner as desired. Such securing means, in the preferred embodiment of the invention illustrated, is comprised of a generally U-shaped clamp 34 having spaced, curved leg portions 36 and 38 integrally joined by a transverse base portion 40. In the embodiment of the invention illustrated, the base portion 40 of the clamp 34 includes connecting means in the form of a pair of spaced parallel side walls 42 and 44 which project toward the housing 12 and which are provided with inturned flanges 46 and 48, respectively, adapted to have a tight sliding fit in grooves 50 and 52, respectively, provided in a mounting member 54 projecting generally tangentially from the housing 12 and formed integrally with the peripheral wall 14 of the housing 12.

An end wall 56 provided on the mounting member 54 serves as a stop to retain the flanges 46 and 48 in the grooves 50 and 52, respectively. Such a construction enables the housing 12 to be easily removed from the clamp, as for cleaning or storage purposes, and thereafter readily remounted on the clamp without the use of tools. A clamping bolt 58 is provided which extends between the free end portions of the legs 36 and 38 of the clamp 34, the bolt 58 being secured by a conventional wing nut 60 whereby the clamp 34 may be tightly clamped to the handle 32.

Figure 3:
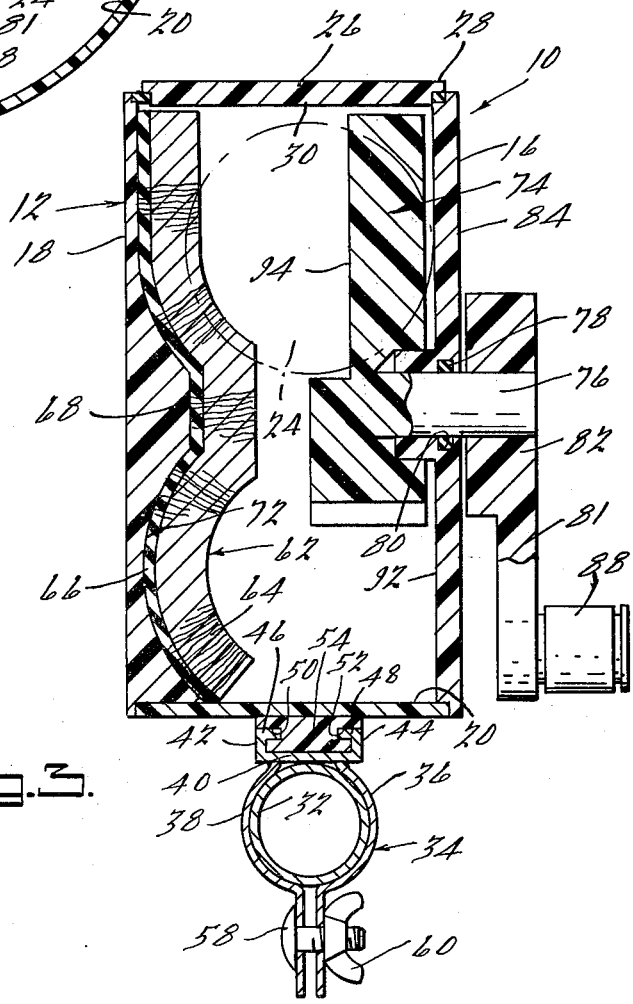
FIG. 3 is a cross sectional view of the structure illustrated in FIG. 2, taken on the line 3—3 thereof.
Figure 4:
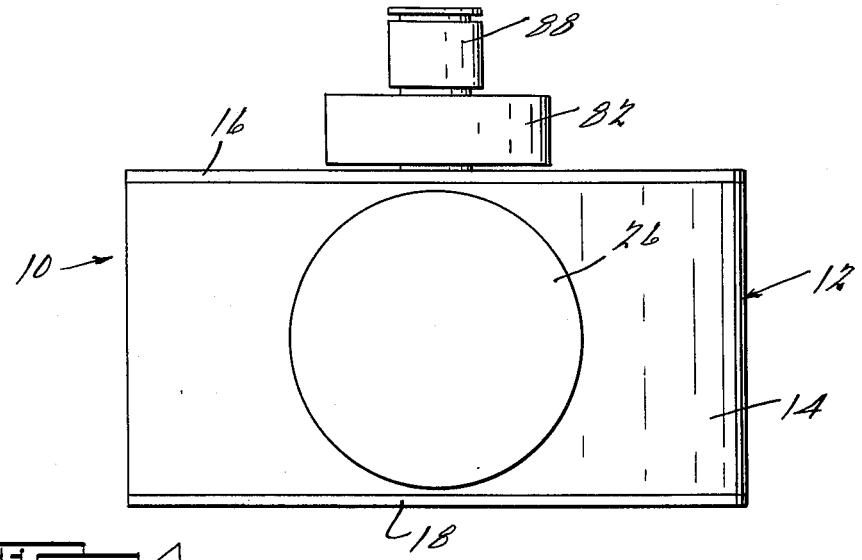
FIG. 4 is a top plan view of the structure illustrated in FIG. 1.

In accordance with the present invention, means is provided for impelling a golf ball through the chamber 20 whereby the golf ball is washed, scrubbed and cleaned as the golf ball travels through the chamber 20 after which the golf ball may be automatically ejected from the chamber 20 through the opening 22 in the peripheral wall 14 of the housing 12. As shown in FIG. 3, in the embodiment of the invention illustrated, ball scrubbing means, generally designated 62, is provided in the chamber 20, such scrubbing means being of generally shallow, concave, hemi-toroidal configuration and being comprised of relatively stiff bristles 64 which are preferably formed of plastic or other suitable water resistant material and which have one end portion thereof embedded in a suitable resilient matrix 66 that may be formed of any suitable material, the matrix 66 being fixed to the side wall 18 of the housing 12, which includes a hub portion 68 which projects partially into the chamber 20 as illustrated in FIG. 3. With such a construction, the free ends of the bristles are disposed on or define a segment of an imaginary, generally hemitorus having a radius of curvature, as illustrated in the drawings, substantially less than the radius of curvature of a conventional golf ball in a zone extending approximately 270 degrees circumferentially around the hemitorus while in the zone extending approximately 45 degrees on either side of the opening 22 the radius of curvature of the hemi-torus is substantially greater than the radius of curvature of a golf ball whereby a golf ball may be readily inserted in and/or ejected from the chamber 20 through the opening 22. The outer side of the resilient matrix 66 is preferably fixed to the inner surface 72 of the side wall 18 by any suitable means, such as by a water proof adhesive, to maintain the scrubbing means in its desired location within the chamber 20.

A drive member 74 is provided which is disposed in the chamber 20 on the side thereof opposite the scrubbing means, the drive member 74 being fixed to a rotatable shaft 76 that extends through a conventional liquid tight bearing 78 mounted in a centrally disposed opening 80 provided in the end wall 16 of the housing 12. The shaft 76 is fixed to a crank 81 having an enlarged collar portion 82 disposed adjacent the outer surface 84 of the end wall 16 whereby the drive member 74 and the collar portion 82 cooperate to limit longitudinal movement of the shaft 76. The crank 81 includes a crank handle 88 projecting outwardly therefrom whereby the drive member 74 may be manually rotated in the chamber 20 about the axis of the shaft 76 (coinciding with the longitudinal axis of the chamber 20) through the agency of the crank handle 88 in a conventional manner.

Figure 2:
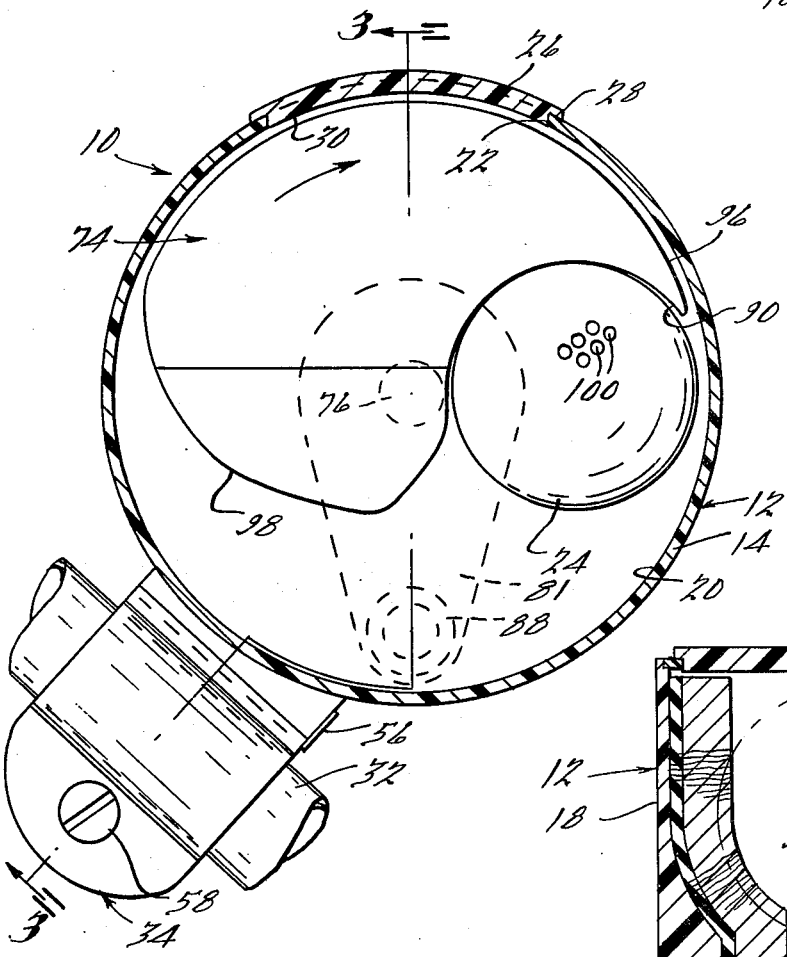
FIG. 2 is a cross sectional, side elevational view of the structure illustrated in FIG. 1, and illustrating the manner in which a golf ball is impelled through the washer during the washing and scrubbing process.

A substantially semi-cylindrical (C-shaped) concave drive surface 90 is provided on the drive member 74, the drive surface 90 projecting axially into the cylindrical chamber 20 toward the bristles 64. The distance between the inner surface 92 of the wall 16 and the ends of the bristles 64 is preferably slightly less than the diameter of a conventional golf ball, and the width of the drive surface 90 is such that the inner edge 94 thereof is disposed at a distance approximately one-half the distance between the inner surface 92 of the wall 16 and the vertical midplane of a golf ball disposed in the chamber 20. The inside diameter of the cylindrical wall 14 is preferably approximately two and one-half times the diameter of a conventional golf ball and the maximum diameter of the drive member 74 is preferably slightly less than the inside diameter of the cylindrical wall 14. The C-shaped drive surface 90 preferably extends to the outside edge 96 of the drive member and the curvature of the outer surface of the drive member reverses approximately adjacent the axis of the shaft 76 so as to provide a convex cam surface 98 which functions in a manner to be described hereinafter in greater detail. The concave drive surface 90 is adapted to engage and drive a golf ball around the chamber 20 in a substantially circular path, while simultaneously rotating the ball, and over the bristles 64 in a clockwise direction, as viewed in FIG. 2, when the handle 88 is turned in the appropriate direction. The generally C-shaped configuration of the drive surface 90 prevents jamming of the balls against the inner surface of the cylindrical wall 14 of the housing. While the concave drive surface 90 tends to drive a golf ball in a rotating circular path over the bristles 64, when the free ends of the bristles engage the dimples 100 conventionally provided in the periphery of a golf ball, the free ends of the bristles also intermittently interfere with the rotating and rolling action of the golf ball so that the golf ball not only rolls over the bristles but also rotates or spins in random directions about various axes as the ball moves through the chamber with the result that the entire surface of a golf ball is scrubbed by the bristles after the ball has completed several passes around the chamber 20. The configuration of the scrubbing means serves to bias the end portions of the bristles against the surface of a ball being washed whereby the bristles also tend to partially envelop the surface of a golf ball and obtain substantial area washing contact therewith.

As previously mentioned, means is provided for automatically ejecting the golf balls from the chamber 20 through the opening 22 in the peripheral wall 14 of the housing 12 after the golf balls have been washed. In the embodiment of the invention illustrated, such means is comprised of a convex cam surface 98 of generally involute configuration which is formed on the drive member 74 and also projects into the chamber 20. The width of the cam surface 98 is approximately one-half the width of the chamber 20, and the length of the cam surface extends for approximately one-half the diameter of the drive member 74, the cam surface gradually rising along a generally involute curve toward the outside circular surface 96.

Figure 5:
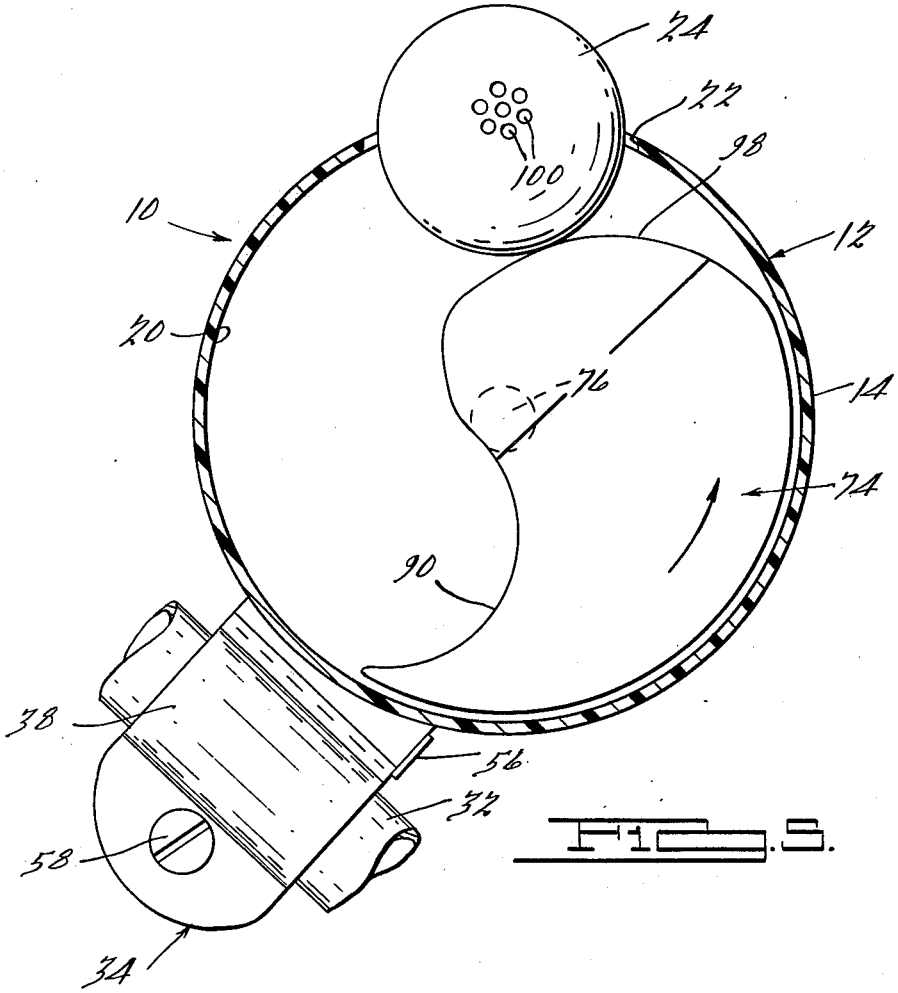
FIG. 5 is a cross sectional view similar to FIG. 2, and illustrating the manner in which a golf ball is ejected from the washer after the ball has been washed and scrubbed and the cover removed from the washer.

As shown in FIG. 5, when the drive member 74 is rotated in a counterclockwise direction, as viewed in FIG. 5, the convex cam surface 98 of the drive member initially engages the adjacent peripheral surface of a golf ball at a point intermediate the center of the ball and the axis of the shaft 76 whereby a component of force is provided which tends to roll the golf ball radially outwardly along the cam surface 98 toward the periphery of the chamber 20 with the result that when the golf ball is aligned with the opening 22 the golf ball is ejected from the chamber 20 through the opening 22 (the cap 26 having previously been removed) when the drive member 74 reaches the position illustrated in FIG. 5.

While a preferred embodiment of the invention has been illustrated and described, it will be understood that various changes and modifications may be made without departing from the spirit of the invention.

What is claimed is:

1. A portable golf ball washer comprising, in combination, a housing having a peripheral wall and spaced end walls defining a cylindrical chamber having a longitudinal axis, said peripheral wall defining an opening communicating with said chamber, ball scrubbing means disposed in said chamber adjacent one of said end walls, said ball scrubbing means being of generally concave, hemi-toroidal configuration and including a plurality of bristles having the free ends thereof projecting into said chamber and disposed on a segment of an imaginary hemi-torus having an inside surface with a radius of curvature substantially less than the radius of curvature of a golf ball, a manually actuatable drive member including a concave drive surface of generally semi-cylindrical configuration and rotatable in one direction about said axis to impel a golf ball in an orbital path around the longitudinal axis of said chamber and in engagement with said scrubbing means while simultaneously rotating said ball about random axes of said ball, said manually actuatable drive member also including a convex cam surface of generally involute configuration and rotatable in the opposite direction about said axis for ejecting said ball from said chamber through said opening, and removable cap means for closing said opening.

2. A portable golf ball washer comprising, in combination, a housing having a peripheral wall and spaced end walls defining a substantially cylindrical chamber having a longitudinal axis, said peripheral wall having an opening therein communicating with said chamber, ball scrubbing means disposed in said chamber adjacent one of said walls, said scrubbing means being of generally concave configuration and including a plurality of bristles extending into said chamber whereby free ends of said bristles are disposed on a segment of an imaginary hemi-torus, a drive member disposed in said chamber adjacent the other wall of said housing and extending only partially axially across said chamber, said drive member being mounted for rotation about an axis coinciding with the longitudinal axis of said chamber, said drive member having a concave drive surface of generally semi-cylindrical configuration projecting axially into said chamber, said concave drive surface being adapted to engage and drive a golf ball in a substantially circular orbital path through said chamber about the longitudinal axis of said chamber, said drive member also having a convex cam surface of generally involute configuration disposed in angularly spaced relationship with respect to said concave drive surface, said convex cam surface extending generally radially with respect to the longitudinal axis of said cylindrical chamber, said convex cam surface of said drive member being adapted to engage a golf ball and eject the same through the opening defined by said peripheral wall, means including crank means for manually rotating said drive member, and means for releasably clamping said housing to a support.

* * * * *